US007178847B1

(12) United States Patent
Mui

(10) Patent No.: US 7,178,847 B1
(45) Date of Patent: Feb. 20, 2007

(54) ILLUMINATED MAGNIFYING TWEEZERS

(76) Inventor: Stephanie A. Mui, 34 Silver Hollow, North Brunswick, NJ (US) 08902

( * ) Notice: Subject to any disclaimer, the term of this patent is extended or adjusted under 35 U.S.C. 154(b) by 63 days.

(21) Appl. No.: 11/087,272

(22) Filed: Mar. 23, 2005

Related U.S. Application Data

(60) Provisional application No. 60/558,723, filed on Apr. 1, 2004.

(51) Int. Cl.
*B25B 9/02* (2006.01)

(52) U.S. Cl. ..... 294/99.2; 606/211

(58) Field of Classification Search ..... 294/3, 294/25, 33, 99.2; 606/211; 81/6, 7, 7.5; 359/803, 809, 810
See application file for complete search history.

(56) References Cited

U.S. PATENT DOCUMENTS 3,287,547 A * 11/1966 Spedding ..... 362/119
3,510,204 A * 5/1970 Jack ..... 359/810
4,401,434 A 8/1983 Harris
4,494,543 A 1/1985 Hart
4,524,647 A 6/1985 Holoff
4,836,596 A * 6/1989 Owen ..... 294/99.2
5,263,754 A 11/1993 Coleman
5,311,365 A 5/1994 Klearman
5,358,297 A 10/1994 Coleman
5,740,611 A 4/1998 Scloss
6,179,847 B1 1/2001 Possum
6,502,587 B1 1/2003 Kellum

* cited by examiner

*Primary Examiner*—Dean J. Kramer

(57) ABSTRACT

A single unit illuminated magnifying tweezers apparatus used to facilitate the gripping and handling of small objects comprising a housing, a magnifying lens, a light source and tweezers. The tweezers are pivotally mounted within the cavity of the housing such that the gripping ends of the tweezers can be pivoted into the focal range of the magnifying lens, which in turn lies within a light beam projected by the light source. The tweezers are retracted snugly within the housing for convenient transport and storage. The apparatus allows the user, with one hand, to easily manipulate the tweezers to grip a target object, which along with the ends of the tweezers, are both illuminated and magnified.

10 Claims, 3 Drawing Sheets

ILLUMINATED MAGNIFYING TWEEZERS

CROSS-REFERENCE TO RELATED APPLICATION

This application claims the benefit of provisional patent application Ser. No. 60/558,723, filed Apr. 1, 2004 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention generally relates to an apparatus that combines tweezers, a magnifying lens and a light source and more particularly to an apparatus that is operable with one hand and concurrently provides direct illumination and magnification to the gripping ends of the tweezers and its immediate surrounding area.

2. Prior Art

Tweezers are used for a wide variety of applications. In the home, they are used to remove splinters, insect stingers or thorns embedded in one's skin. Tweezers are also used as grooming tools to groom eyelashes, eyebrows, mustaches and to remove unwanted hair. They are also used in certain repair work, model building, stamp collecting and other endeavors involving the handing of small items. Tweezers also have a myriad of industrial applications where small articles must be handled with precision. For example, in numerous mechanical assembly operations such as watch repair, tweezers are needed to handle and position the small parts for assembly work. In each application, the item being handled is generally quite small making visibility an inherent problem.

U.S. Pat. No. 4,524,647 to Holoff discloses tweezers in combination with a light source and a magnifying lens. However, insofar as known to the applicant, such prior art assembly has certain deficiencies:

(a) The tweezer assembly is not malleable and is not ergonomically designed so that it fits comfortably within the palm of a user. This adversely affects the ability of the user to manipulate the tweezers to handle a small object.

(b) The tweezers do not retract completely into its housing. The inability of the tweezers to completely retract while in a storage position makes the tweezer assembly prone to breakage and susceptible to snagging on clothing or other items with which such assembly is stored. This limits the ability to conveniently transport and store the assembly when not in use.

(c) The light source is enclosed within the housing of the tweezer assembly, which impairs direct light projection and limits the options to effectively incorporate light sources that can project light fields ranging from a tight, narrow beam to a wider beam output.

(d) The light source needs to be activated using a separate actuating button. Full operation of the tweezer assembly entails a multiple step process to activate the light source and to pivot the tweezers downward.

The apparatus disclosed herein helps significantly to solve these problems.

3. Objects and Advantages

Accordingly, several objects and advantages of my invention are:

(a) to provide a handheld device that integrates a magnifying lens, light source and tweezers and facilitates the gripping and handling of small objects by providing illumination and magnification of the ends of the tweezers, the target object and its immediate surrounding area;

(b) to provide an integrated tweezers-light-magnifier apparatus which is adapted for easy storage and transport when the apparatus is not in use;

(c) to provide an integrated tweezers-light-magnifying apparatus whereby the light source is not enclosed within the housing and is positioned directly above the gripping ends of the tweezers which allows for direct light projection and options to use light sources which allow for different light projection fields.

(d) to provide an integrated tweezers-light-magnifying apparatus composed of minimal mechanical parts, which enhances reliability and allows for ease of use and low cost manufacturing;

(e) to provide an ergonomically designed integrated tweezers-light-magnifying apparatus which does not adversely affect the user's ability to manipulate the tweezers;

(f) to provide an attractive and ergonomically designed apparatus that will enhance the marketability of the product;

The foregoing and further objects and advantages will become apparent from a consideration of the ensuing description and drawings.

SUMMARY

In accordance with the invention, an apparatus which integrates a magnifying lens, light source and tweezers that provides illumination and magnification of the gripping ends of the tweezers and its immediate surrounding area to facilitate the gripping and handling of small objects by the tweezers.

DRAWINGS—FIGURES

DRAWINGS—REFERENCE NUMERALS

Figure 1:
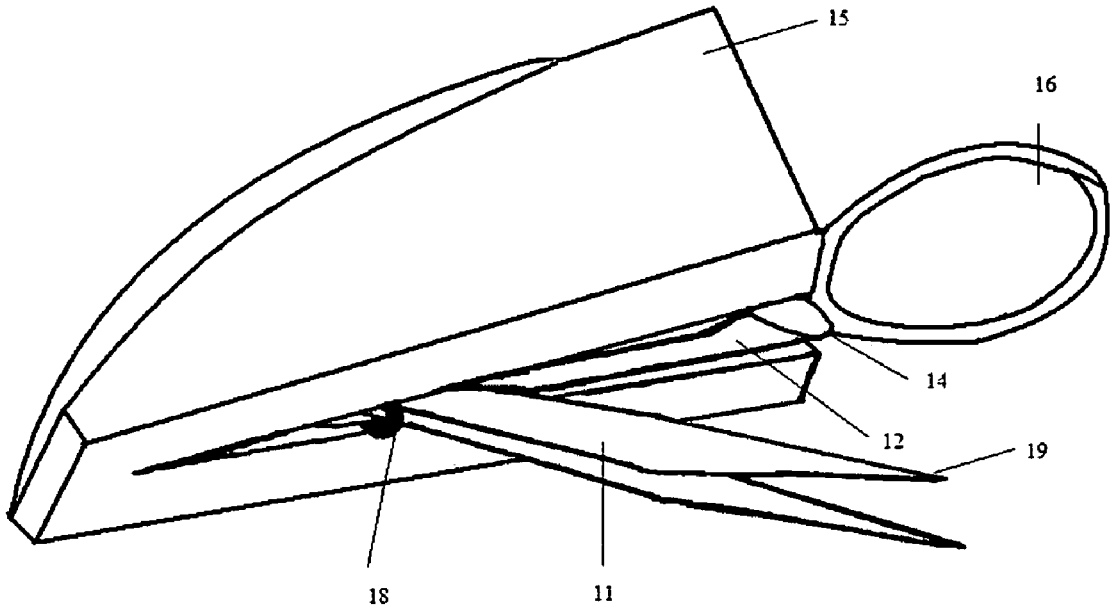
FIG. 1 is a perspective view of the invention.
Figure 2:
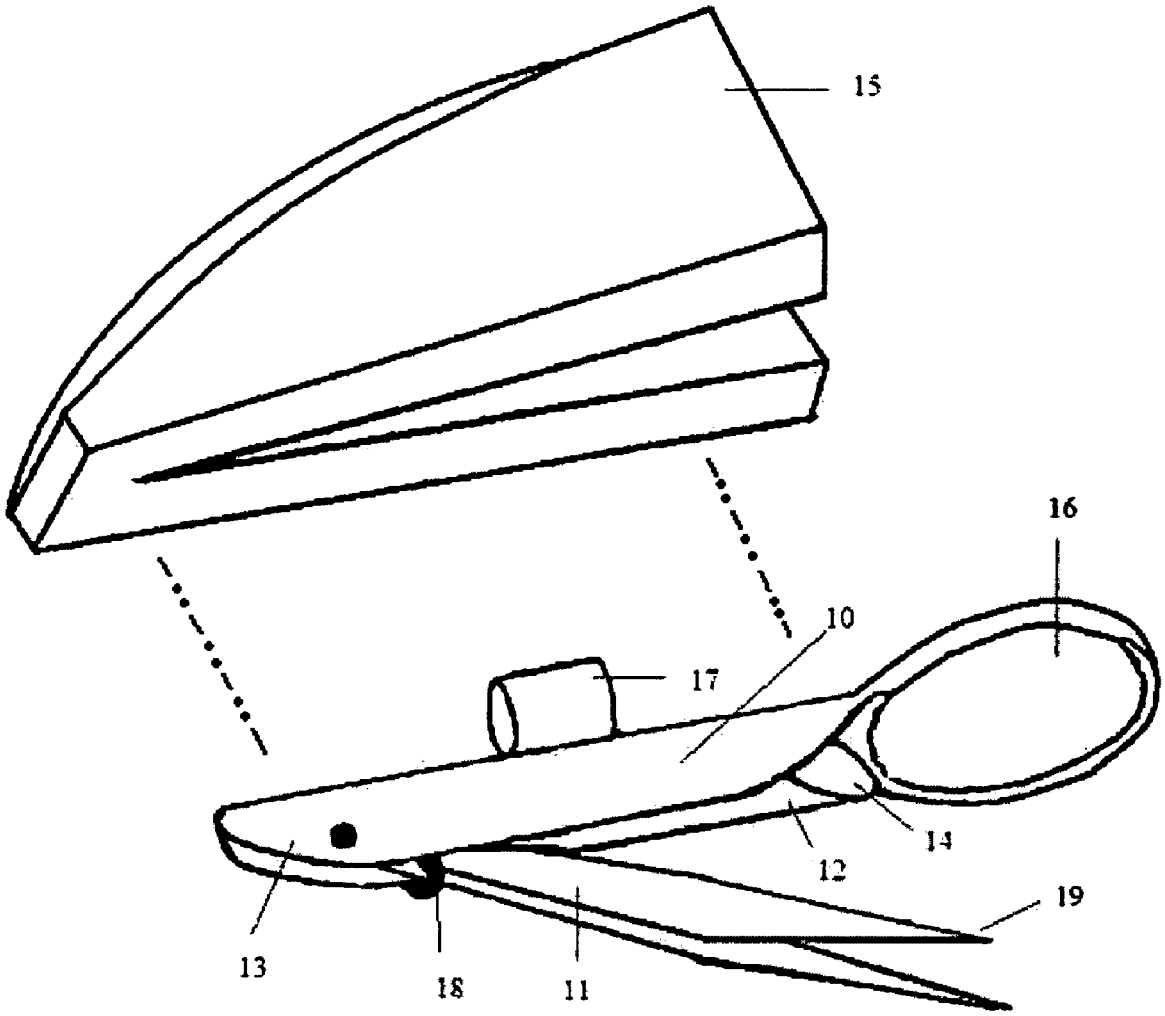
FIG. 2 is a perspective view of the invention with the cover removed.
Figure 3:
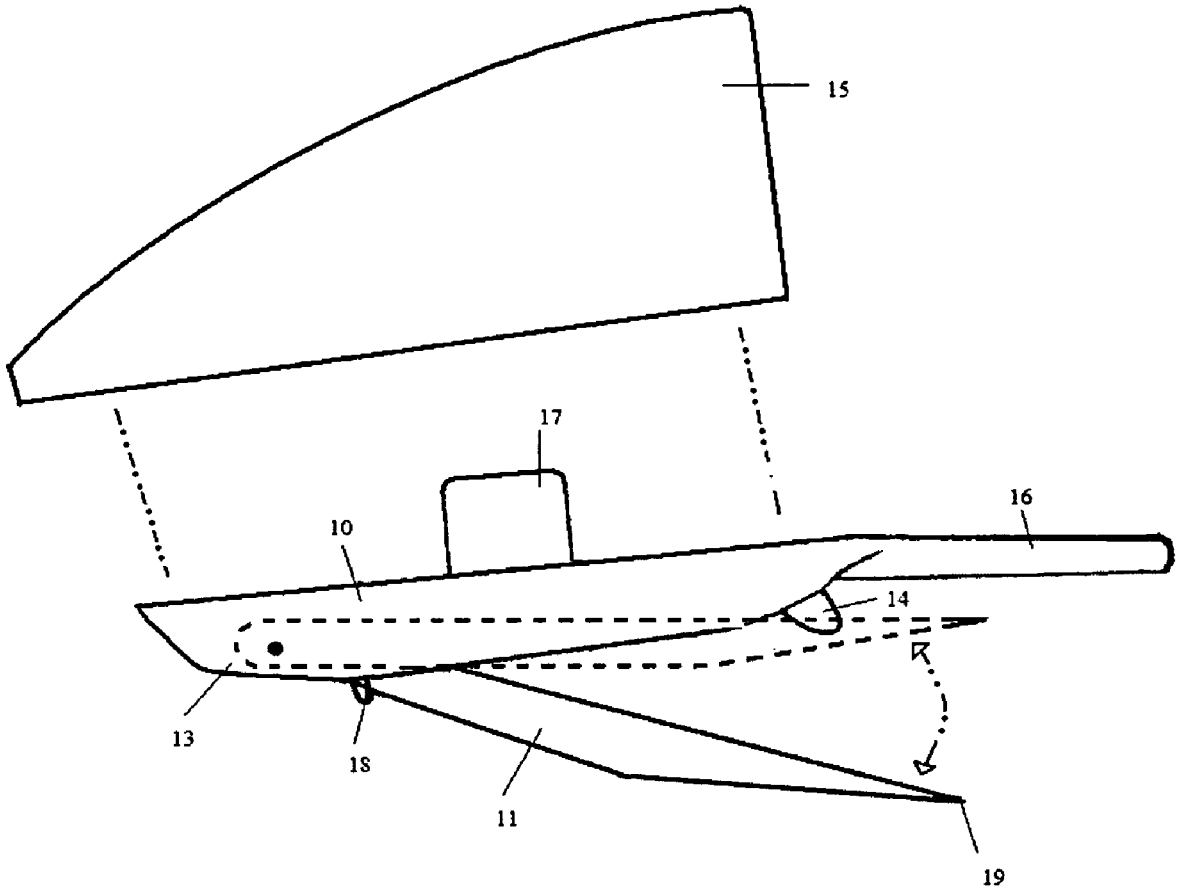
FIG. 3 is a side view of the invention with the cover removed.

10 housing
11 tweezers
12 cavity of housing
13 aft end of the housing
14 light source
15 protective cover
16 magnifying lens
17 battery reservoir
18 contact switch
19 gripping ends of the tweezer DETAILED DESCRIPTION—PREFERRED EMBODIMENT—FIGS. 1, 2 and 3

FIG. 1 is a perspective view of a combination tweezers, magnifier and light apparatus constructed in accordance with a preferred embodiment of the invention.

FIG. 2 is a perspective view of the apparatus with the cover removed. The apparatus comprises a protective cover (15); a light source (14); an elongated housing (10) with a cavity of a predetermined size (12); a magnifier or magnifying lens (16) and metal tweezers (11) pivotally connected within the cavity (12) of the housing (10). The tweezers (11) are pivoted at the aft end of the housing (13) such that the tweezers (11) can be pivoted downwardly from within the cavity (12) when in use and securely retracted within the cavity (12) when not in use. The housing (10) at its front end, carries the magnifying lens (16). An electrically conductive battery reservoir (17) is mounted to the top exterior surface of the housing (10) to hold one or more batteries (not shown), for example a pair of 1.5 volt button batteries. The battery reservoir (17) is connected by electrically insulated wiring (not shown) through an opening in the housing (10) to a contact of the light source (14) positioned within the cavity (12) of the housing (10) just aft of the magnifier (16). The electrically insulated wire leading from the battery reservoir is extended beyond one elongated exterior side of the housing (10), continues under the housing (10) and is attached to the other elongated exterior side of the housing (10) so as to form a loop positioned near the aft end of the housing (13) approximately underneath the pivotal mount point of the tweezers (11). The section of such insulated wire loop that the metal tweezers (11) touch when pivoted into the focal length of the magnifying lens (16) is exposed to reveal the electrical wire within and serves as a contact switch (18) by which the light source (14) is activated.

When the metal tweezers (11) makes contact with the contact switch (18) the current flows from the batteries within the battery reservoir (17) to the contact point of the light source (14) through the light source (14) filament and back to the housing (10) thereby automatically activating the light source (14). When the light source (14) is activated, a beam of light is projected onto the gripping ends of the tweezers (19) and its immediate surrounding area thereby allowing the user to locate and grip a target object by viewing the target object through the magnifier (16).

The housing (10) comprises an elongated body with the cavity (12) sized to accommodate the tweezers (11) such that the tweezers (11) fit snugly within the cavity (12) when the tweezer (11) is in its retracted position as shown in FIG. 3. The housing (10) is formed of any electrically conductive metal. The tweezers (11) are spring resilient and may be conventionally formed of any electrically conductive metal. The contact switch (18) can be constructed of any known flexible electrically conductive metal wiring.

The light source (14) is positioned within the cavity (12) of the housing (10) just aft of the magnifying lens (16) such that the beam of illumination is directed onto the gripping ends of the tweezers (19) and its immediate surrounding area. The light source (14) can be any known source of light of suitable size, including a LED bulb. By using an appropriate light source (14), the apparatus may be configured to have light output of various colors, intensity or beam fields depending on its intended use.

An alternate embodiment of the apparatus can be constructed by the mounting of an actuating button of a conventional locking type (not shown) to the exterior end of the housing (10) so that the button can be depressed to activate the light source (14).

The protective cover (15) serves to protect the batteries and the wiring as well as to make the apparatus more attractive and comfortable to use. The protective cover (15) is removable so that the batteries may be replaced. As indicated in FIG. 1, the protective cover (15) covers the length of said housing (10) beginning adjacent to said magnifying lens (16). The protective cover (15) is ergonomically shaped to conform with the palms of the user such that the top of the protective cover (15) curves gently downward from the front to the back. In the preferred embodiment, the protective cover (15) is constructed of a malleable material such as foam so that it will compress when the tweezers (11) are pinched.

The apparatus's simplicity in design allows for ease of manufacture. The apparatus is fabricated using a minimum of mechanical parts, which makes it less likely to malfunction, and capable of being manufactured at a low cost especially when compared to the costs of separate tweezers, magnifying lens and flashlight.

Operations—Preferred Embodiment—FIGS. 1, 2 and 3

The apparatus is generally operated as follows. The tweezer (11) is brought out from its retracted position depicted in FIG. 3 by pivoting the tweezers (11) downwardly from the cavity (12) of the housing (10) as illustrated by the phantom lines in FIG. 3.

A single motion of pivoting the tweezers (11) downwardly will concurrently bring the gripping ends of the tweezer (19) into the focal length of the magnifying lens and into the illumination path of the light source (14) and the tweezers (11) in contact with the contact switch (18). As the metal tweezers (11) come in contact with the contact switch (18), the light source (14) will automatically illuminate.

The coordination of the positioning of the gripping ends of the tweezers (19) in the area of intersection of the light beam and focal range of the magnifying lens provides excellent illumination and magnification to the gripping ends of the tweezers' prongs (19) thereby facilitating the use of the tweezers (11) in manipulating or removing small objects such as ticks, splinters or unwanted hairs. The apparatus is typically used by holding the housing (10) of the apparatus in the palm of one hand positioned such that the tweezers (11) may be manipulated with the thumb and forefinger of the same hand. The protective cover (15) is ergonomically designed to conform to the palm of the user and is made of malleable material that will compress when the tweezers (11) are pinched allowing a user to manipulate the tweezers easily with one hand.

The pivotal mounting of the tweezers (11) allows the tweezers (11) to be stored securely within the cavity (12) of the housing (10) as illustrated in FIG. 3 thus allowing the apparatus to be conveniently transported or stored when not in use.

CONCLUSION, RAMIFICATIONS, AND SCOPE

Accordingly the reader will see that the integrated tweezer-light-magnifier apparatus of this invention is readily useable to facilitate the gripping and handling of small objects by providing illumination and magnification of the ends of the tweezers, the target object and its immediate surrounding area without adversely affecting the user's ability to manipulate the tweezer. The apparatus can be used in any application where tweezers are typically used such as repair work, model building, and assembly work. Furthermore, this invention has the additional advantages in that:

The single unit construction of the apparatus and its incorporation of all necessary features preclude the need to carry or have available separate tweezers, magnifier and flashlight;

Its compact size, fully retractable design and light weight allows for portability and convenient storage. The apparatus can be easily packed in a campers knapsack, travel bag, first aid kit or ones pocket;

Its ergonomic design and the malleable material used for the outer body of the apparatus allows for comfortable and easy one hand operation;

The apparatus's simplicity in design allows for the use of a minimum of mechanical parts. This enhances reliability of the apparatus and allows for low cost manufacturing;

The apparatus is simple and convenient to operate;

While the above description contains many specificities, these should not be construed as limitations on the scope of the invention, but as exemplifications of the presently preferred embodiments thereof. Many other ramifications and variations are possible within the teachings of the invention. For example, a cover could be fitted around the magnifying lens and the ends of the tweezers to further enhance durability and ease of transport and storage.

Thus the scope of the invention should be determined by the appended claims and their legal equivalents, and not be the examples given.

The invention claimed is:

1. A tweezer apparatus, comprising:

(a) an elongated housing formed of any electrically conductive metal having a cavity of a predetermined size said housing having a lens securement frame adjacent one end thereof;

(b) a magnifying lens carried within said securement frame said lens defining a given focal range;

(c) a light source mounted within the cavity of said housing and positioned such that the path of illumination emanating there from passes through said focal range;

(d) a pair of tweezers formed of any electrically conductive metal, one end of said tweezers being pivotally mounted within the cavity of said housing, such that said tweezers can be pivoted from a storage position within said cavity to an operative position within said focal range of said lens and the path of illumination of said light source;

(e) a battery power source carried by said housing;

(f) means to carry current from said battery power supply such that contact to said means by said metal tweezers when pivoted to an operative position will activate said light source;

whereby a single motion of pivoting said tweezers downwardly will concurrently activate said light source, bring said tweezers into said focal length of said magnify lens and into the illumination path of said light source such that the gripping ends of said tweezers are concurrently magnified and illuminated to facilitate visibility thereof.

2. The apparatus of claim 1 wherein a removable cover is attached to the exterior of said housing.

3. The apparatus of claim 1 wherein a removable ergonomic cover, designed to conform to the palm of the user, is attached to the exterior of said housing.

4. The apparatus of claim 1 wherein a removable cover, constructed with compressible or malleable material, is attached to the exterior of said housing.

5. A tweezer apparatus, comprising:

(a) an elongated housing having a cavity of a predetermined size said housing having a lens securement frame adjacent one end thereof;

(b) a magnifying lens carried within said securement frame said lens defining a given focal range;

(c) a light source mounted within the cavity of said housing and positioned such that the path of illumination emanating there from passes through said focal range;

(d) means carried by said housing to transmit current from a battery power source for activating said light source;

(e) a removable cover attached to the exterior of said housing;

(f) a pair of tweezers, one end of said tweezers being pivotally mounted within said cavity of said housing, such that the gripping ends of said tweezers can be pivoted from a storage position within said cavity to an operative position within said focal range of said lens and the path of illumination of said light source;

whereby the gripping ends of said tweezers are concurrently magnified and illuminated to facilitate visibility thereof.

6. The apparatus of claim 5 wherein said removable cover is ergonomically designed to conform to the palm of the user.

7. The apparatus of claim 5 wherein said removable cover is constructed with compressible or malleable material.

8. A tweezer apparatus adapted to be comfortably and securely held within the palm and manipulated by one hand of the user said apparatus comprising:

(a) an elongated housing having a cavity of a predetermined size said housing having a lens securement frame adjacent one end thereof;

(b) a magnifying tens carried within said securement frame said lens defining a given focal range;

(c) a light source mounted within the cavity of said housing and positioned such that the path of illumination emanating there from passes through said focal range;

(d) means carried by said housing to transmit current from a battery power source for activating said light source;

(e) a removable cover attached to the exterior of said housing;

(f) a pair of tweezers, one end of said tweezers being pivotally mounted within said cavity of said housing such that the gripping ends of said tweezers can be pivoted from a storage position within said cavity to an operative position within said focal range of said lens and the path of illumination of said light source;

whereby said apparatus can be comfortably and securely held and operated with one hand and the gripping ends of said tweezers are concurrently magnified and illuminated to facilitate visibility thereof.

9. The apparatus of claim 8 wherein said removable cover is ergonomically designed to conform to the palm of the user.

10. The apparatus of claim 8 wherein said removable cover is constructed with compressible or malleable material.

* * * * *